US011013957B2

(12) United States Patent
Wang

(10) Patent No.: US 11,013,957 B2
(45) Date of Patent: May 25, 2021

(54) RESPIRATORY PRESSURE TRAINING STRAP AND USING METHOD THEREOF

(71) Applicant: Yaxian Liu, Beijing (CN)

(72) Inventor: Feng Wang, Beijing (CN)

(73) Assignee: Yaxian Liu, Beijing (CN)

( * ) Notice: Subject to any disclaimer, the term of this patent is extended or adjusted under 35 U.S.C. 154(b) by 16 days.

(21) Appl. No.: 16/510,931

(22) Filed: Jul. 14, 2019

(65) Prior Publication Data

US 2019/0336822 A1 Nov. 7, 2019

(30) Foreign Application Priority Data

Oct. 17, 2018 (CN) ..... 201830578277.1

(51) Int. Cl.
*A63B 23/18* (2006.01)
*A63B 21/00* (2006.01)
*A63B 23/02* (2006.01)

(52) U.S. Cl.
CPC ..... *A63B 23/18* (2013.01); *A63B 21/4005* (2015.10); *A63B 21/4007* (2015.10); *A63B 21/4009* (2015.10); *A63B 23/0244* (2013.01); *A63B 21/00178* (2013.01); *A63B 21/00189* (2013.01); *A63B 23/0205* (2013.01); *A63B 23/0233* (2013.01); *A63B 2225/09* (2013.01)

(58) Field of Classification Search
CPC ..... A63B 23/18; A63B 23/02; A63B 23/0205; A63B 23/0233; A63B 23/0244; A63B 2208/02; A63B 2225/09; A63B 2225/093; A63B 2209/00; A63B 2209/10; A63B 21/00178; A63B 21/00189; A63B 21/002; A63B 21/0023; A63B 21/4005; A63B 21/4009; A63B 21/4007
See application file for complete search history.

(56) References Cited

U.S. PATENT DOCUMENTS

| | | | | |
|---|---|---|---|---|
| 6,231,488 | B1 * | 5/2001 | Dicker | A63B 21/0552 482/124 |
| 7,374,523 | B2 * | 5/2008 | Weir | A63B 21/0004 482/148 |
| 10,561,881 | B2 * | 2/2020 | Matsuura | A63B 21/4025 |
| 10,576,324 | B2 * | 3/2020 | Dolcetti | A63B 21/065 |
| 2008/0142004 | A1 * | 6/2008 | Wasnick | A63B 23/18 128/200.24 |
| 2008/0146957 | A1 * | 6/2008 | Wasnick | A63B 23/18 600/534 |
| 2010/0076358 | A1 * | 3/2010 | Richardson | A63B 23/0244 602/19 |

* cited by examiner

*Primary Examiner* — Megan Anderson

(57) ABSTRACT

A respiratory pressure training strap includes a waist-back support, two shoulder straps, a chest strap and a belly strap; wherein the waist-back support is a main body of the respiratory pressure training strap, an upper portion of the waist-back support is connected to first ends of the shoulder straps, and a lower portion of the waist-back support is connected to the belly strap as well as second ends of the shoulder straps; wherein two ends of the chest strap are respectively connected to a left shoulder strap and a right shoulder strap of the shoulder straps; wherein the belly strap laterally extends from the lower portion of the waist-back support; wherein respiratory pressure regulators are respectively arranged on the waist-back support, the chest strap, and the belly strap. The present invention can realize the respiratory posture correction for the user by the reverse pressures.

8 Claims, 4 Drawing Sheets

1

RESPIRATORY PRESSURE TRAINING STRAP AND USING METHOD THEREOF

CROSS REFERENCE OF RELATED APPLICATION

The present invention claims priority under 35 U.S.C. 119(a-d) to CN 201830578277.1, filed Oct. 17, 2018.

BACKGROUND OF THE PRESENT INVENTION

Field of Invention

The present invention relates to a technical field of health, and more particularly to a respiratory pressure training strap and a using method thereof.

Description of Related Arts

Proper breathing methods and scientific inhalation are important prerequisites for daily human health care, daily training for athletes, daily training for fitness enthusiasts, and the development of singing techniques. For postoperative vocal reconstruction, vocal disorders, and mental illness treatment programs, the proper breathing methods also play an important role. Breathing is the action performed by two groups of nerves together with muscle groups. The most important thing is to train the inspiratory muscles and the inspiratory nerves.

However, how to mobilize passive consciousness, use passive consciousness to actively and correctly inhale, maximize the development of the lungs, make the lungs work actively, make the diaphragms strong and powerful, and improve the human body quality on the basis of the original body is unknown. There is currently no good solution which can help users train scientific breathing methods.

SUMMARY OF THE PRESENT INVENTION

An object of the present invention is to provide

To overcome defects in the related art, the present invention provides a respiratory pressure training strap and a using method thereof, so as to assist a user in establishing a correct breathing method and posture.

Accordingly, in order to accomplish the above objects, the present invention provides a respiratory pressure training strap, comprising: a waist-back support, two shoulder straps, a chest strap and a belly strap;

wherein the waist-back support is a main body of the respiratory pressure training strap, an upper portion of the waist-back support is connected to first ends of the shoulder straps, and a lower portion of the waist-back support is connected to the belly strap as well as second ends of the shoulder straps;

wherein two ends of the chest strap are respectively connected to a left shoulder strap and a right shoulder strap of the shoulder straps;

wherein the belly strap laterally extends from the lower portion of the waist-back support;

wherein respiratory pressure regulators are respectively arranged on the waist-back support, the chest strap, and the belly strap.

Preferably, at least two belly respiratory pressure regulators are arranged on an internal side of the belly strap.

Preferably, a back respiratory pressure regulator is arranged on an internal side of the upper portion of the waist-back support; and a waist respiratory pressure regulator is arranged on an internal side of the lower portion of the waist-back support.

Preferably, a chest respiratory pressure regulator is arranged on an internal side of a joint of the chest strap.

Preferably, the chest strap is movably connected to the left shoulder strap and the right shoulder strap of the shoulder straps, so as to adjust the chest strap up and down along the left shoulder strap and the right shoulder strap.

Preferably, each of the respiratory pressure regulators has a protrusion on a front side and a support rib structure on a back side.

Preferably, each of the respiratory pressure regulators has a core of a hard resin structure which is wrapped by a sponge layer, and has an external layer of nylon fabric.

Preferably, the belly respiratory pressure regulators have a hand-type structure; during utilization, the belly respiratory pressure regulators are respectively located at a left belly side and a right belly side.

Preferably, the waist respiratory pressure regulator and the back respiratory pressure regulator are shell-shaped.

The present invention also provides a using method of a respiratory pressure training strap, comprising steps of:

putting the respiratory pressure training strap on a user body, and passing left and right arms through a left shoulder strap and a right shoulder strap respectively; adjusting waist-back support to corresponding back and waist positions, and adjusting a height and a tightness of a chest strap before fixing the chest trap at a chest position of a user;

then adjusting a tightness of a belly strap to fix the belly strap around a user belly; and during breathing, assisting the user in training inspiratory muscle groups and inspiratory nerve sensitivity through forces applied on the user by respiratory pressure regulators.

The technical solution provided by embodiments of the present invention may provide the following beneficial effects: through the technical solution of the present invention, the respiratory pressure training strap is provided, which can realize the respiratory posture correction for the user by the reverse pressures, and achieve the purpose of training inspiratory muscle groups and inspiratory nerve sensitivity. Ultimately, the present invention helps the user to fix the correct inspiratory posture, to assisting in establishing the correct breathing method; makes the human spine positive, which is beneficial to achieve better breathing training effect; and assists the user to establish a three-dimensional breathing method in which the transverse iliac muscle is the leading intercostal muscle and latissimus dorsi as well as the lumbar muscle are involved, and to use the method in daily life.

The above general description and the following detailed description are intended to be illustrative and not to be limiting.

DETAILED DESCRIPTION OF THE PREFERRED EMBODIMENT

Embodiments according to the present invention will be described in detail herein, examples of which are illustrated in the accompanying drawings. The following description refers to the same or similar elements in the different figures unless otherwise indicated. The following embodiments do not represent all embodiments consistent with the present instant invention. Instead, they are merely examples of devices and methods consistent with aspects of the present invention as detailed in the appended claims.

The terms used in the present invention are for the purpose of describing particular embodiments only, and are not intended to limit the disclosure. The singular forms "a", "the" and "said" may also refer to multiple elements if possible. It should also be understood that the term "and/or" used herein refers to and encompasses any and all possible combinations of one or more of the associated listed items.

It should be understood that although the terms first, second, third, and so on may be used in the present invention to describe various information, such information should not be limited to these terms. These terms are only used to distinguish the same type of information from each other. For example, the first information may also be referred to as second information without departing from the scope of the present invention. Similarly, the second information may also be referred to as first information. Depending on the context, the word "if" as used herein may be interpreted as "when" or "while" or "in response to a determination."

Figure 1:
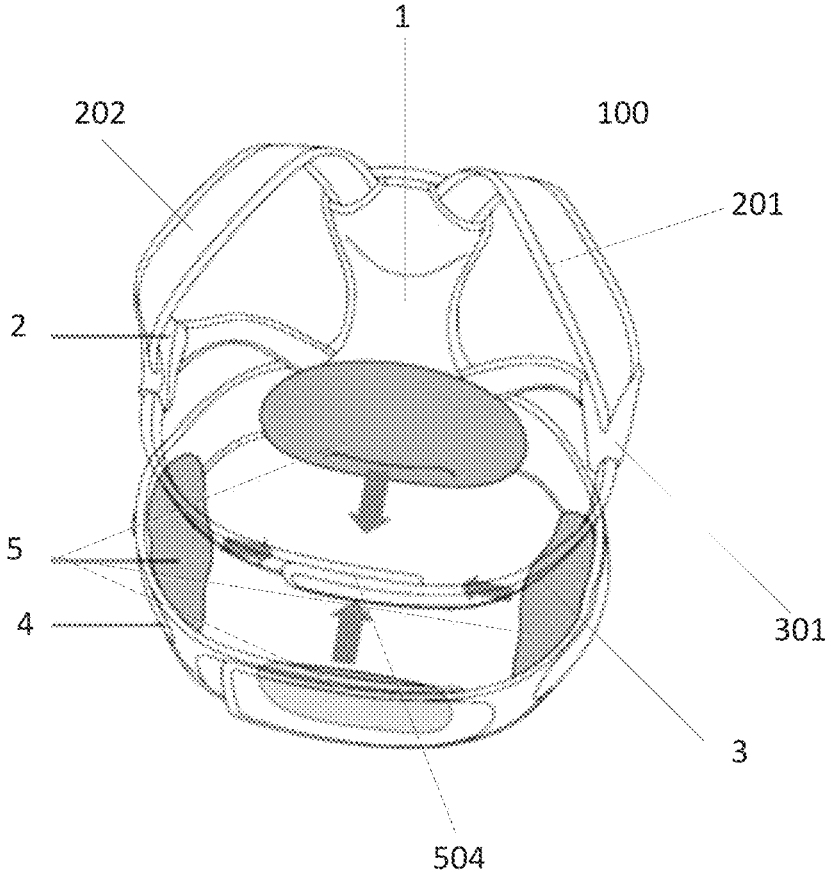
FIG. 1 is a structural view of a respiratory pressure training strap according to an embodiment of the present invention.

Referring to FIG. 1, a respiratory pressure training strap 100 according to an embodiment is provided, comprising: a waist-back support 1, two shoulder straps 2, a chest strap 3 and a belly strap 4; wherein the waist-back support 1 is a main body of the respiratory pressure training strap 100, an upper portion of the waist-back support 1 is connected to first ends of the shoulder straps 2, and a lower portion of the waist-back support 1 is connected to the belly strap 4 as well as second ends of the shoulder straps 2; wherein two ends of the chest strap 3 are respectively connected to a left shoulder strap 201 and a right shoulder strap 202 of the shoulder straps 2; wherein the belly strap 4 laterally extends from the lower portion of the waist-back support 1; wherein respiratory pressure regulators 5 are respectively arranged on the waist-back support 1, the chest strap 3, and the belly strap 4.

According to the embodiment, the main body of the respiratory pressure to training strap 100 is a waist-back support 1, and the left shoulder strap 201 and the right shoulder strap 202 are respectively connected to both sides of the upper portion of the waist-back support 1. The chest strap 3 is connected between the left and right shoulder straps, and the belly strap 4 is connected to both sides of the lower portion of the waist-back support 1. It should be noted that the connection in the present invention may be a case where the two are integrated, or a case where the two are separated. For example, connection between the shoulder straps 2 and the waist-back support 1, as well as connection between the belly strap 4 and the waist-back support 1 may be formed integrally, or may be formed separately with some connecting means. On the internal sides of the waist-back support 1, the chest strap 3, and the belly strap 4, that is, the side facing the user's body, the respiratory pressure regulators 5 are further provided. By adjusting tightness of the chest strap 3 and the belly strap 4, pressures of the respiratory pressure regulators 5 against the user's body can be adjusted, thereby achieving the purpose of training the respiratory nerves and breathing muscles.

Preferably, at least two belly respiratory pressure regulators 501 are arranged on an internal side of the belly strap 4.

Figure 2:
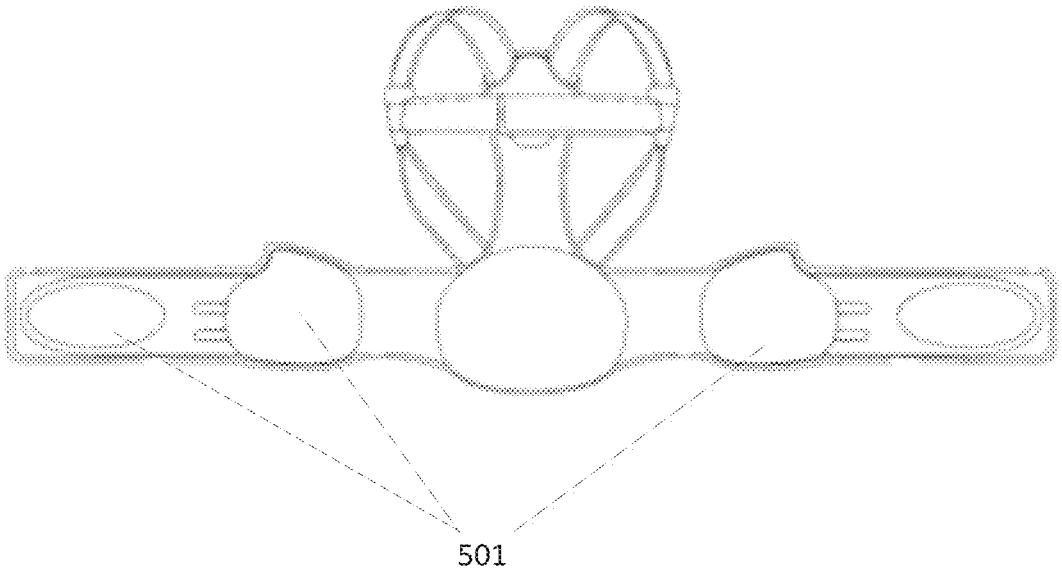
FIG. 2 is a front elevational view of the respiratory pressure training strap according to the embodiment of the present invention.

Referring to FIG. 2, on the belly strap 4, around the user's abdomen, left, right and front belly respiratory pressure regulators 501 are provided. Of course, it is also possible to provide only the left and right belly respiratory pressure regulators 501. When the user wears the respiratory pressure training strap 100, tightness is self-adjusted, so that different users can independently select different strengths for breathing training.

Preferably, a back respiratory pressure regulator 501 is arranged on an internal side of the upper portion of the waist-back support 1; and a waist respiratory pressure regulator 503 is arranged on an internal side of the lower portion of the waist-back support 1.

Figure 3:
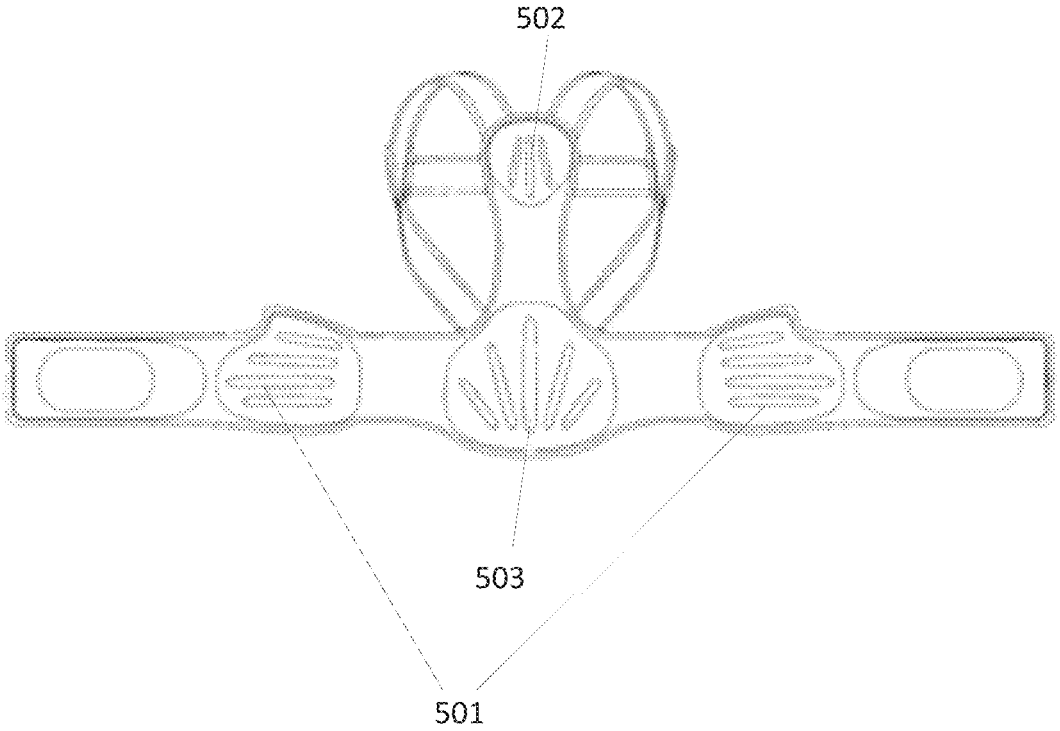
FIG. 3 is a rear elevational view of the respiratory pressure training strap according to the embodiment of the present invention.

Referring to FIG. 3, the waist-back support 1 serves as the main body. When the user wears the respiratory pressure training strap 100, the upper portion of the waist-back support 1 corresponds to the back of the user, and the lower portion of the waist-back to support 1 corresponds to the waist of the user. The back respiratory pressure regulator 502 and the waist respiratory pressure regulator 503 are respectively disposed at the upper and lower portions of the waist-back support 1 to realize pressure adjustment of the back and the waist when the user performs breathing training.

Preferably, a chest respiratory pressure regulator 504 is arranged on an internal side of a joint of the chest strap 3.

Referring to FIG. 1, left and right ends of the chest strap 3 are respectively connected to the left shoulder strap 201 and the right shoulder strap 202. At the same time, in order to facilitate the user to adjust the tension of the chest strap 3, the chest strap 3 is formed by a left section and a right section, and the connection between the two sections is adjustable with hook and loop fasteners. On the internal side of the joint of the chest strap 3, that is, the side facing the user's body, is provided with the chest respiratory pressure regulator 504, and the pressure thereof against the user's body can be adjusted by the tightness of the connection of the joint.

Preferably, the chest strap 3 is movably connected to the left shoulder strap 201 and the right shoulder strap 202 of the shoulder straps 2, so as to adjust the chest strap 3 up and down along the left shoulder strap 201 and the right shoulder strap 202.

Referring to FIG. 1, the chest strap 3 is respectively connected to the left shoulder strap 201 and the right shoulder strap 202, and the joint therebetween is movable, allowing the chest strap 3 to be adjusted along the direction of the shoulder straps 2, facilitating different users to move the position of the chest strap 3 up and down according to themselves, so as to achieve the most suitable use position. The joint 301 is a triangular structure, the chest strap 3 is fixed at one corner of the triangle, and the other two corners are hollow to be sleeved on the left shoulder strap 201 or the right shoulder strap 202. When the user needs to adjust the position of the chest strap 3, it can be achieved by moving the joint 301 up and down along the shoulder straps 2.

Preferably, each of the respiratory pressure regulators 5 has a protrusion on a front side and a support rib structure on a back side.

Preferably, each of the respiratory pressure regulators 5 has a core of a hard resin structure which is wrapped by a sponge layer, and has an external layer of nylon fabric.

In the present invention, the respiratory pressure regulator 5 is used to generate a stimulating effect on the user's body, which is provided with the protrusion toward the user's side for concentrating pressure to generate stimulation, and a side facing away from the user is provided with a support rib structure to increase structural strength of the respiratory pressure regulator 5.

The core of the respiratory pressure regulator 5 is a the hard resin structure, which is wrapped with the sponge layer for improving touch of the respiratory pressure regulator 5 in contact with the user, and the external layer is form be the nylon fabric to protect the sponge layer.

According to other embodiments, the respiratory pressure regulator 5 has a size range of 15 cm in length and 12 cm in height, or 25 cm in length and 20 cm in height. Of course, the adjustment can also be made according to the actual user group, which is not limited in the present invention.

Preferably, the belly respiratory pressure regulators 501 have a hand-type structure, during utilization, the belly respiratory pressure regulators 501 are respectively located at a left belly side and a right belly side.

Referring to FIGS. 2 and 3, the belly respiratory pressure regulators 501 have the hand-shaped structure. When the user wears the respiratory pressure training strap 100, the left and right belly respiratory pressure regulators 501 are respectively on the left and right sides of the user's abdomen, like the left and right hands of the user are placed in the corresponding positions, wherein the left belly respiratory pressure regulator 501 has a shape of the left hand, and the right belly respiratory pressure regulator 501 has a shape to of the right hand. The hand-shape belly respiratory pressure regulators 501 can embrace the abdomen of the user like the real left and right hands, so as to provide better support and stimulation of the abdominal muscles.

Preferably, the waist respiratory pressure regulator 503 and the back respiratory pressure regulator 502 are shell-shaped.

Referring to FIG. 3, the waist respiratory pressure regulator 503 and the back respiratory pressure regulator 502 are both in the shape of a shell with a large lower portion and a small upper shape, wherein the waist respiratory pressure regulator 503 has a normal shell shape, and the back respiratory pressure regulator 502 has a reverse shell shape.

According to another embodiment, a using method of a respiratory pressure training strap 100 is provided, comprising steps of:

putting the respiratory pressure training strap 100 on a user body, and passing left and right arms through a left shoulder strap 201 and a right shoulder strap 202 respectively; adjusting waist-back support 1 to corresponding back and waist positions, and adjusting a height and a tightness of a chest strap 3 before fixing the chest trap at a chest position of a user;

then adjusting a tightness of a belly strap 4 to fix the belly strap 4 around a user belly; and during breathing, assisting the user in training inspiratory muscle groups and inspiratory nerve sensitivity through forces applied on the user by respiratory pressure regulators 5.

Figure 4:
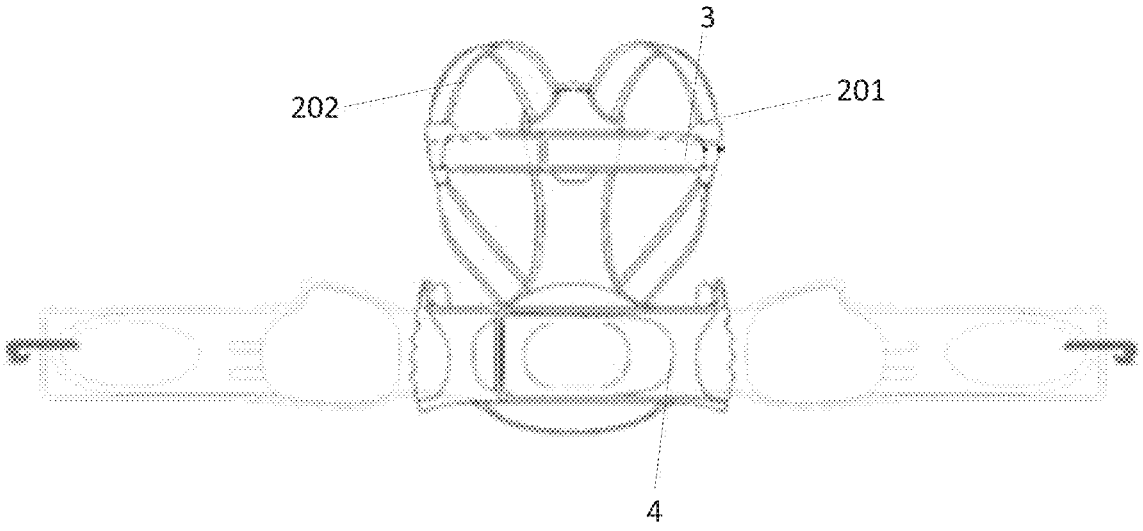
FIG. 4 is a sketch view of a wearing manner of the respiratory pressure training strap according to the embodiment of the present invention.

Referring to FIG. 4, when the user wants to wear the respiratory pressure training strap 100, a wearing method is as follows:

opening the chest strap 3 and the belly strap 4 by the user, and passing the left and right arms through the left shoulder strap 201 and the right shoulder strap 202 respectively; adjusting waist-back support 1 to a correct position corresponding the back and waist positions;

then adjusting the height of the chest strap 3 to the center of the chest, adjusting the tightness of the chest strap 3 through a joint thereof; and adjusting the tightness of the belly strap 4 to fix the belly strap 4 around the user belly, wherein there is a certain pressure on the stomach and the ribs on both sides and the tip of the sternum near the Tanzhong hole, and the pressure is adjusted to the appropriate level according to the user's tolerance.

During training, due to the natural expansion of the body during inhalation, the pressure point of the respiratory pressure regulator 5 receives a reverse pressure, thereby achieving the purpose of training the inspiratory muscle group and the inspiratory nerve sensitivity. Through the pressures of the respiratory pressure regulators 5 at different points, inspiratory volume and depth of the lungs during each inhalation action are increased, which can increase oxygen carrying capacity and activity of the human red blood cells. The pressure of respiratory pressure regulator 5 can also maximize the amount of carbon dioxide and exhaust gas emitted from the human body.

With the respiratory pressure training strap 100, the present invention helps the user to fix the correct inspiratory posture, assisting in establishing the correct breathing method; makes the human spine positive, which is beneficial to achieve better breathing training effect; and assists the user to establish a three-dimensional breathing method in which the transverse iliac muscle is the leading intercostal muscle and latissimus dorsi as well as the lumbar muscle are involved, and to use the method in daily life. The present invention is applicable to athletes' breathing training; regulation of depression, neurosis, anxiety patients' breathing, adjuvant therapy; singing training for vocalists, teachers, broadcasters, etc.; breathing training during postoperative recovery period, treatment period for all disease patients; and breathing training for congenital and acquired physique.

The above description only represents the preferred embodiments of the present invention, and is not intended to be limiting. Therefore, this invention includes any modifications, equivalents, improvements, etc., which are made within the spirit and principles of the present invention.

What is claimed is:

1. A respiratory pressure training strap, comprising: a waist-back support, two shoulder straps, a chest strap and a belly strap;

wherein the waist-back support is a main body of the respiratory pressure training strap, an upper portion of the waist-back support is connected to first ends of the two shoulder straps, and a lower portion of the waist-back support is connected to the belly strap as well as second ends of the two shoulder straps;

wherein two ends of the chest strap are respectively connected to a left shoulder strap and a right shoulder strap of the two shoulder straps;

wherein the belly strap laterally extends from the lower portion of the waist-back support;

wherein respiratory pressure regulators are respectively arranged on the waist-back support, the chest strap, and the belly strap.

2. The respiratory pressure training strap, as recited in claim 1, wherein the respiratory pressure regulators comprise at least two belly respiratory pressure regulators arranged on an internal side of the belly strap.

3. The respiratory pressure training strap, as recited in claim 2, wherein the at least two belly respiratory pressure regulators have a hand-shaped structure; during utilization, the at least two belly respiratory pressure regulators are respectively located at a left belly side and a right belly side.

4. The respiratory pressure training strap, as recited in claim 1, wherein the respiratory pressure regulators comprise a back respiratory pressure regulator arranged on an internal side of the upper portion of the waist-back support; and the respiratory pressure regulators comprise a waist respiratory pressure regulator arranged on an internal side of the lower portion of the waist-back support.

5. The respiratory pressure training strap, as recited in claim 4, wherein the waist respiratory pressure regulator and the back respiratory pressure regulator are shell-shaped.

6. The respiratory pressure training strap, as recited in claim 1, wherein the respiratory pressure regulators comprise a chest respiratory pressure regulator arranged on an internal side of a joint of the chest strap.

7. The respiratory pressure training strap, as recited in claim 1, wherein the chest strap is movably connected to the left shoulder strap and the right shoulder strap of the two shoulder straps, so as to adjust the chest strap up and down along the left shoulder strap and the right shoulder strap.

8. A using method of a respiratory pressure training strap, comprising steps of:

putting the respiratory pressure training strap on a user body, and passing left and right arms through a left shoulder strap and a right shoulder strap respectively, wherein an upper portion of a waist-back support is connected to first ends of the left shoulder strap and the right shoulder strap, and a lower portion of the waist-back support is connected to a belly strap as well as second ends of the left shoulder strap and the right shoulder strap; adjusting the waist-back support to corresponding back and waist positions, and adjusting a height and a tightness of a chest strap before fixing the chest strap at a chest position of a user;

then adjusting a tightness of the belly strap to fix the belly strap around a belly of the user; and during breathing, assisting the user in training inspiratory muscle groups and inspiratory nerve sensitivity through forces applied on the user by respiratory pressure regulators.

* * * * *